US007621080B2

(12) United States Patent
Stanfield

(10) Patent No.: US 7,621,080 B2
(45) Date of Patent: Nov. 24, 2009

(54) PROTECTIVE SLEEVE ASSEMBLY FOR A POST

(76) Inventor: Barney Stanfield, 5223 Bascule Ave., Woodland Hills, CA (US) 91364

( * ) Notice: Subject to any disclaimer, the term of this patent is extended or adjusted under 35 U.S.C. 154(b) by 245 days.

(21) Appl. No.: 11/656,139

(22) Filed: Jan. 20, 2007

(65) Prior Publication Data

US 2008/0172980 A1 Jul. 24, 2008

(51) Int. Cl.
*E04D 27/42* (2006.01)

(52) U.S. Cl. ..... 52/170; 52/834; 52/835; 52/844

(58) Field of Classification Search ..... 52/170, 52/834, 844, 835, 836, 843, 169.12, 465, 52/716.1, 718.01, 718.02
See application file for complete search history.

(56) References Cited

U.S. PATENT DOCUMENTS

| | | | | |
|---|---|---|---|---|
| 94,195 | A | 9/1869 | Fisher | |
| 1,402,561 | A | 1/1922 | Banks | |
| 5,082,231 | A | 1/1992 | Knowles | |
| 5,165,663 | A | 11/1992 | Wells | |
| 5,535,555 | A | 7/1996 | Boyd et al. | |
| 5,553,433 | A * | 9/1996 | Lang | 52/483.1 |
| 5,571,229 | A | 11/1996 | Fitzsimmons | |
| 5,625,988 | A | 5/1997 | Killick | |
| 5,632,464 | A | 5/1997 | Aberle | |
| 5,704,580 | A | 1/1998 | Peery, Jr. | |
| 5,832,675 | A | 11/1998 | Zuares | |
| 5,853,167 | A * | 12/1998 | West et al. | 256/66 |
| 5,901,525 | A | 5/1999 | Doeringer | |
| 5,956,920 | A * | 9/1999 | Davis | 52/844 |
| 6,041,559 | A * | 3/2000 | Schickert et al. | 52/165 |
| 6,098,353 | A * | 8/2000 | Stanfield | 52/170 |
| 6,260,328 | B1 * | 7/2001 | Fowler et al. | 52/834 |
| 6,688,583 | B2 * | 2/2004 | Merrick | 256/1 |
| 6,718,710 | B2 * | 4/2004 | Platt | 52/296 |
| 6,886,296 | B1 * | 5/2005 | John et al. | 52/170 |
| D521,656 | S * | 5/2006 | Terrels | D25/122 |
| 2001/0000548 | A1 * | 5/2001 | Niehaus | 29/450 |
| 2001/0022056 | A1 * | 9/2001 | Gifford | 52/311.1 |
| 2002/0178684 | A1 * | 12/2002 | Barnett | 52/716.1 |
| 2006/0185270 | A1 * | 8/2006 | Handley et al. | 52/169.14 |
| 2007/0116515 | A1 * | 5/2007 | Woytowich et al. | 404/8 |

* cited by examiner

*Primary Examiner*—Brian E Glessner
*Assistant Examiner*—Adriana Figueroa
(74) *Attorney, Agent, or Firm*—Gene Scott; Patent Law & Venture Group

(57) ABSTRACT

A post has a rectangular cross-sectional shape and mounted on one end of the post is a protective sleeve. The sleeve provides a cylindrical sidewall within which one end of the post is engaged. A bottom cap closes the end of the sidewall sealing the end of the post. A rectangular elastomeric seal is engaged with the sidewall peripheral to the post. A pair of L-shaped moldings are mounted exterior to the elastomeric seal providing engagement within a groove of the elastomeric seal and exerting a sealing force against the elastomeric seal and the post.

4 Claims, 4 Drawing Sheets

PROTECTIVE SLEEVE ASSEMBLY FOR A POST

BACKGROUND OF THE INVENTION

1. Field of the Present Disclosure

This disclosure relates generally to protective sleeves and more particularly to a sleeve for protecting the end of a fence post.

2. Description of Related Art including information disclosed under 37 CFR 1.97 and 1.98.

Fisher, U.S. Pat. No. 94,195, discloses a design for a post support, such design showing a box-like construction with a chiseled lower edge and an open top for receiving a square post. Side fins extend from two opposing sides of the support.

Banks, U.S. Pat. No. 1,402,561, discloses a post support providing a cylindrical receiver, chisel lower edge, disk shaped cap portion, and outwardly and downwardly extending stabilizing teeth.

Knowles, U.S. Pat. No. 5,082,231, discloses a post support for permanent installation at or below ground level including a post receiving collar affixed to fins. The fins have collar supporting shoulders against which a post may rest. A driver/cap/marker has a cap and sleeve with sleeve length the same as the collars length so that when the driver/cap/marker is inserted into the collar the lower edge of the sleeve rests on the shoulders and the underside of the cap/marker rests on top of the collar. The driver/cap/marker serves firstly as a tool for inserting the support into he ground and secondly as a cover for an unused support, and thirdly for marking the location of an unused collar.

Wells, U.S. Pat. No. 5,165,663 discloses a ground anchor for a post including an elongated vertically extending cylindrical PVC tube and including at the lower end of the tube an end member having a cylindrical portion snugly and frictionally fit within the tube and a conical portion projecting downwardly from the tube to a point, the end member having thereon within the tube an upwardly facing drive surface. An elongate driving member is removable insertable into the tube and has at one end a driving which is engagable with the free surface on the end member. In a variation, the tube has at the upper end a collar which includes an axially extending annular flange snugly fir within the upper end of the tube and a further annular flange projecting radially outwardly from the support end of the axial flange.

Boyd et al., U.S. Pat. No. 5,535,555, discloses a breakaway post coupling with a hollow, tubular sleeve which accommodates a ground-mounted stub post and a top, sign-supporting post. The sleeve is held onto the posts by a plurality of pins which engage a corresponding plurality of slots in the sleeve. Collars slidably engage the sleeve and force the pins into the post material as the collars are drawn over the sleeve and pins. A plurality of cutouts in the sleeve define a shear point in the coupling. When the top post is struck by a vehicle, the coupling breaks at the shear point, leaving an intact stub post upon which a new top post can be joined.

Fitzsimmons et al., U.S. Pat. No. 5,571,229, discloses a support structure or ground sleeve for supporting a pole including a cap threadably engagable with an open end of a sleeve body. The ground sleeve includes a sleeve body adapted to be positioned in a ground surface for receiving and supporting a pole and includes at least one flange extending outwardly from the sleeve body for preventing the sleeve from rotating in the ground, a collet for engaging the pole, and an inwardly tapered closed end of the sleeve body for centering an end of the pole. An inwardly tapered race surface of the cap and a plurality of circumferentially-spaced tabs of the sleeve body cooperate to define the collet. In addition, the ground sleeve is formed of a weather resistant non-corrosive material.

Killick, U.S. Pat. No. 5,625,988, discloses a support assembly for a roadside or traffic signpost includes a mounting socket cylinder fixed in the ground for receiving a support post therein. A resilient support means in the form of a pair of O-rings is interposable between the post and the mounting cylinder. A reinforcing collar prevents deformation of adjacent portions of the mounting cylinder and the post.

Aberle, U.S. Pat. No. 5,632,464, discloses a ground pocket support device for removably mounting a post having variable cross-section shape and size. The ground pocket support device includes an elongate ground engaging member having upper and lower end portions. The member is adapted for placement in the ground and defines a hollow post-receiving portion for receiving and supporting a post in a substantially upright position. The ground engaging member further includes elongate wall members and a post wedging mechanism positioned toward the lower end portion for firmly engaging the lower end of a post inserted therewithin. A post-engaging member is disposed at the upper end portion of the ground engaging member. The post-engaging member includes members for removably anchoring a post inserted within the ground engaging member and for adjusting the vertical alignment of the post independent of the vertical alignment between the ground engaging member and the ground in which it is placed.

Peery, Jr., U.S. Pat. No. 5,704,580, discloses a method and apparatus for assembling a selected street pole to a standard sized base. The method includes the step of selecting a street pole of a predetermined configuration. Encircling portions, preferably rings consisting of two semi-circular portions, each having a nestable section with each other and a complementary section with the selected street pole are then provided. The encircling portions are nested together on the standard sized base to connect the standard sized base to the selected street pole thereby continuing the appearance finish of the standard sized base while preventing unauthorized access to an interior of the standard sized base. The apparatus includes the encircling portions to connect the standard sized base to the selected street pole.

Zuares, U.S. Pat. No. 5,832,675, discloses a prefabricated flashing for post bases intended for installation in new or existing construction comprising two different pieces. One piece having a nailing flange which fits snugly around a post whose dimension is five-sixteenths of an inch square, and has a total of eight nail holes and four tapered sides that terminate in a bottom flange. The second piece is shaped and sized similarly to the first except that it is split vertically straight across the nailing flange and on one side has an extension of material which creates a seam.

Doeringer et al., U.S. Pat. No. 5,901,525, discloses an elevated column base for supporting a wood column subjected to high mechanical loads and protecting the column lowermost portion from rot and other deterioration due to exposure to a tropical environment. The column base includes a stanchion, a diaphragm, and a cap, each monolithically molded from a thermoplastic. A first embodiment of the stanchion adapted for a 6.times.6 or 8.times.8 column includes a solid base portion with a cavity which is filled with concrete and plugged with the diaphragm. The stanchion has two pairs of side walls attached to the base portion. Opposed gussets attached to the upper portions of one pair stiffen the side walls against transverse loads. Most of the load carried by the wood column is borne by the concrete and by two horizontal bolts. The diaphragm acts to spread the load force to the base portion and side walls. The load on the diaphragm acts to create a seal against moisture entering the cavity. A second embodiment of the stanchion adapted for a 4.times.4 column does not include gussets. The cap has four lateral faces fitting closely over the stanchion side walls, and a top face with a square aperture formed by four flexible web portions pressing against the wood column. After the column lowermost portion is secured within the stanchion by the bolts, the cap is slid downwardly until the ends of slots in the lateral faces contact the bolts. Each cap bottom corner edge and trough then bound an aperture through which water collected above the diaphragm can drain.

The prior art teaches various means for mounting and protecting a buried end of a post or beam. However, the prior art does not teach a peripheral elastomeric seal that has means for accepting one end of a protective sleeve and that is able to compressed by a molding against a post to attain a water and insect proof enclosure. The present invention fulfills these needs and provides further related advantages as described in the following summary and detailed description and as shown in the accompanying corresponding figures.

BRIEF SUMMARY OF THE INVENTION

This disclosure teaches certain benefits in construction and use which give rise to the objectives described below.

Wooden posts are widely used for outdoor fences and similar applications. Such posts are subject to the elements and insect attack so that they typically need to be replaced periodically. Additionally, such posts are mounted by burying one end into the earth or mounting one end to a concrete footing with metal brackets. These approaches are not aesthetically pleasing and tend to leave the lower end of the post vulnerable to water damage and insect infestation. The above defined prior art devices provide improvements in this field, but clearly, further improvements and post mounting solutions are needed and the present invention is one approach that provides such benefit that is clearly novel and which provides practical benefits over the prior art.

In a preferred embodiment of the present invention, the post has a rectangular cross-sectional shape, typically four inches square, and is mounted within a protective sleeve. The sleeve provides a cylindrical sidewall and a bottom cap closing the end of the sidewall and sealing the end of the post. An elastomeric seal is engaged with the sidewall peripheral to the post, and a pair of L-shaped moldings are mounted exterior to the seal providing engagement within a groove of the elastomeric seal and exerting a sealing force against the elastomeric seal and the post to achieve a waterproof assembly that also is aesthetically pleasing.

A primary objective inherent in the above described apparatus and method of use is to provide advantages not taught by the prior art.

Another objective is to seal the lower end of a post so as to prevent insect attack and water damage.

A further objective is to provide an improved seal between the posts' mounting and the post itself so as to exclude water from the lower end of the post.

A still further objective is to provide a post mounting that is easily installed and later removed as necessary.

A still further objective is to provide a seal that provides mechanical and weather resistant engagement between a sleeve and the post.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
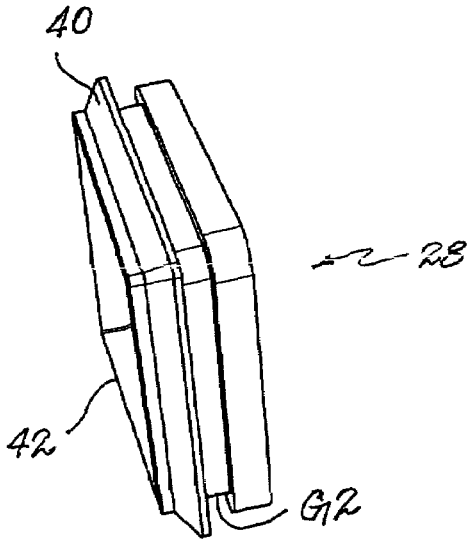
FIGS. 1, 2 and 3 are perspective views of an elastomeric seal of the presently described apparatus as seen from one side, above and below respectively.
Figure 2:
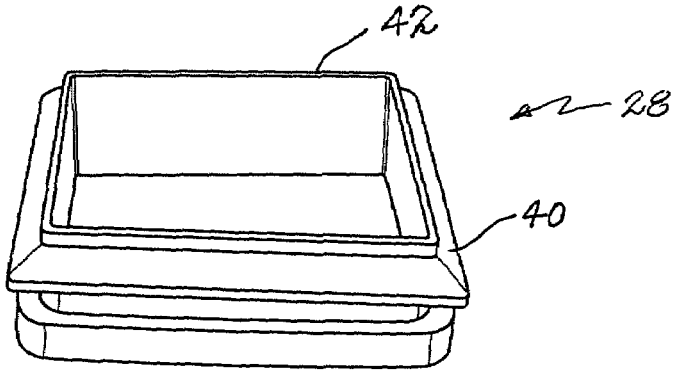
Figure 3:
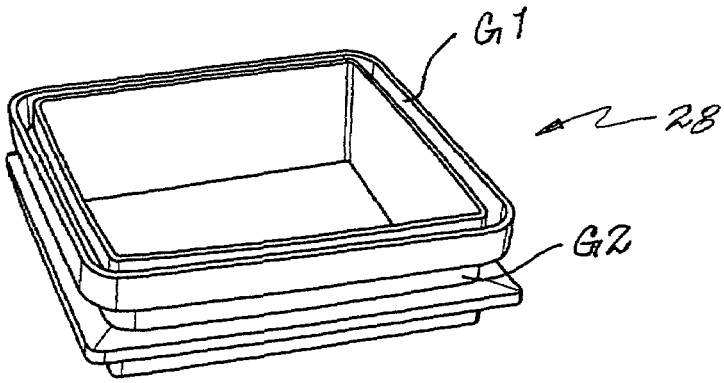
Figure 4:
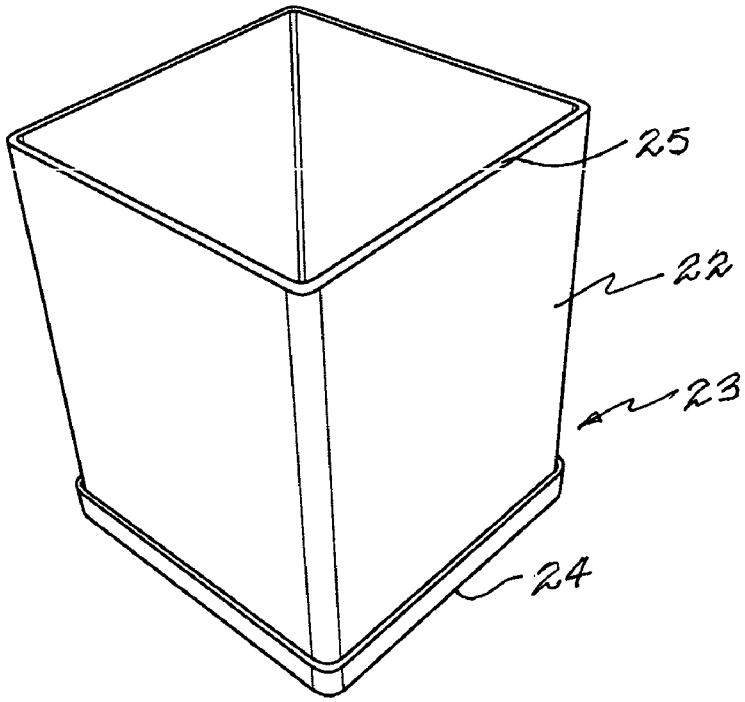
FIGS. 4 and 5 are perspective views of a cylindrical sidewall closed at one end by a cap of the apparatus as seen from above and from below respectively.
Figure 5:
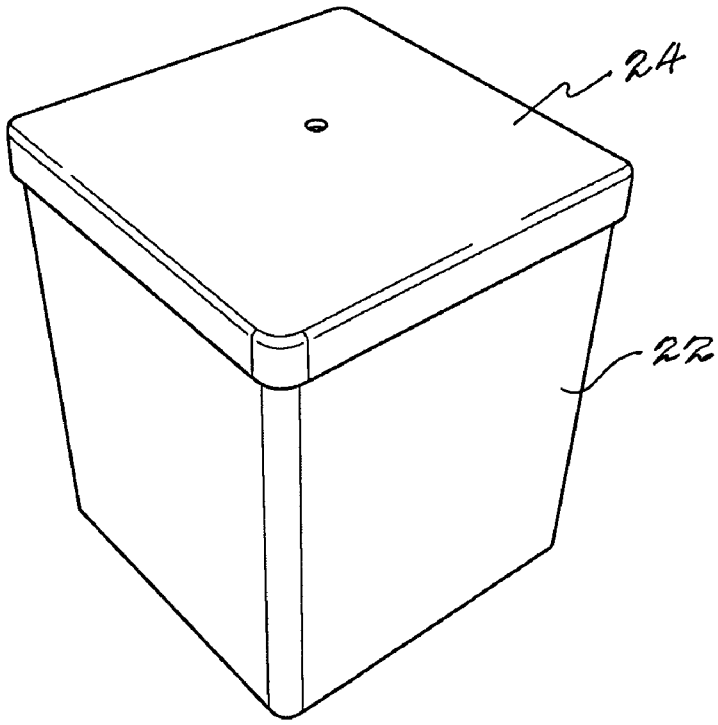
Figure 6:
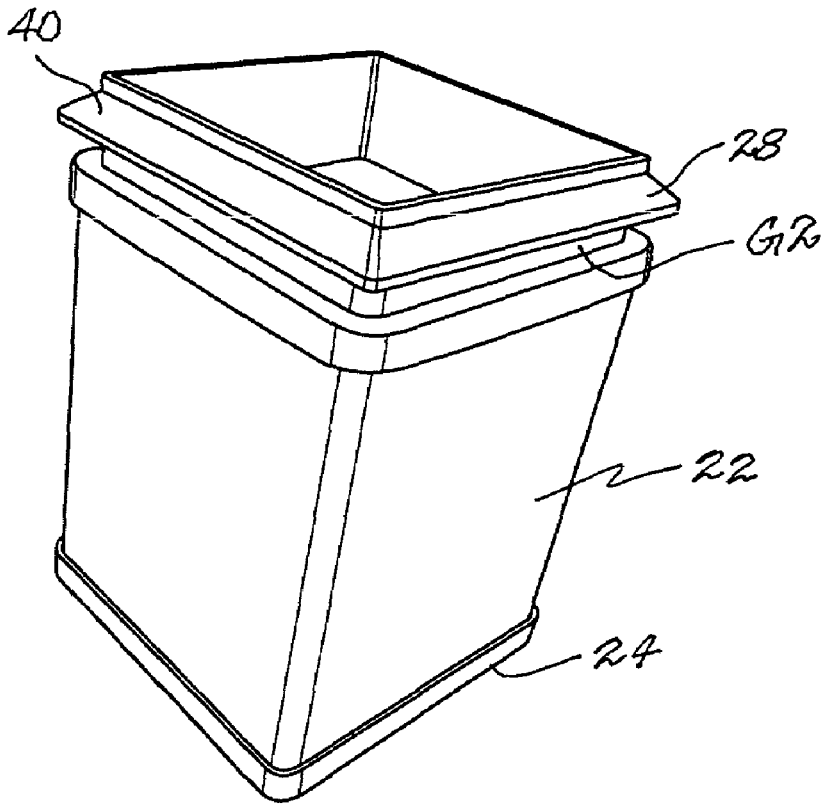
FIG. 6 is a perspective view of the sidewall and cap engaged with an elastomeric seal as seen from above.

Described now in detail is the present invention, a protective sleeve which is mounted on and engages one end of a post, as shown in FIGS. 1-10. An elongate post 10 (FIG. 10), has a rectangular cross-sectional shape and opposing terminal ends. Such a post 10 is widely used and very well known in the art. A protective sleeve 20 is an assembly made up of several components including: a cylindrical sidewall 22 (FIG. 4); a bottom cap 24 (FIG. 5), a pair of identical L-shaped moldings 26 (FIGS. 8 and 10); and a rectangular peripheral elastomeric seal 28 (FIGS. 1-3). Additionally, fastening hardware 30 is used to interconnect the moldings 26 at opposing corners.

Figure 10:
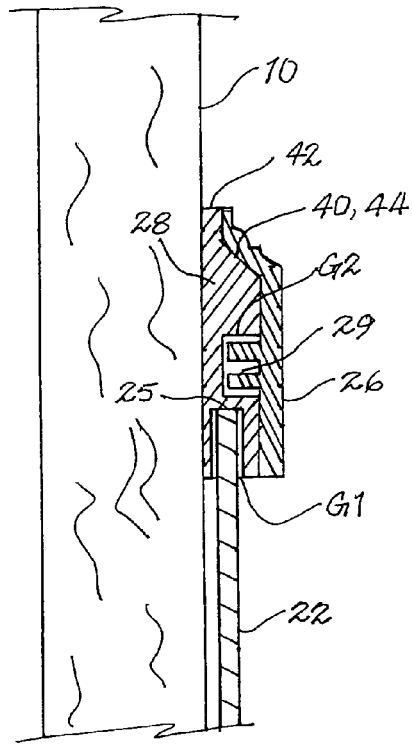
FIG. 10 is a cross sectional view showing the constructional details of the engagement of the elastomeric seal with the molding, sidewall and the post as taken along line 10-10 in FIG. 9.

The cap 24 is engaged with a bottom end 23 of the cylindrical sidewall 22 by a bonding adhesive or other well known attachment means that is able to provide a sealed joint, weather and insect proof. A top edge 25 of the sidewall 22 is positioned within a downwardly directed first groove G1 of the elastomeric seal 28 so that moisture and insects are not able to pass through this joint. To further assure that this joint is impermeable, a bonding adhesive may be inserted into groove G1. This joint is best shown in FIG. 10.

Figure 7:
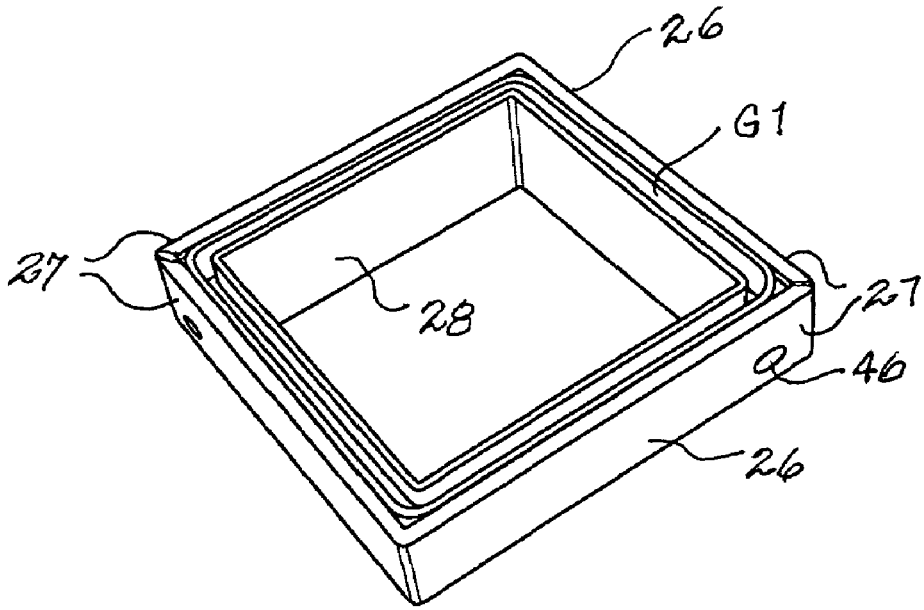
FIGS. 7 and 8 are perspective views of the elastomeric seal engaged with a pair of L-shaped moldings as seen from below and from above respectively.
Figure 8:
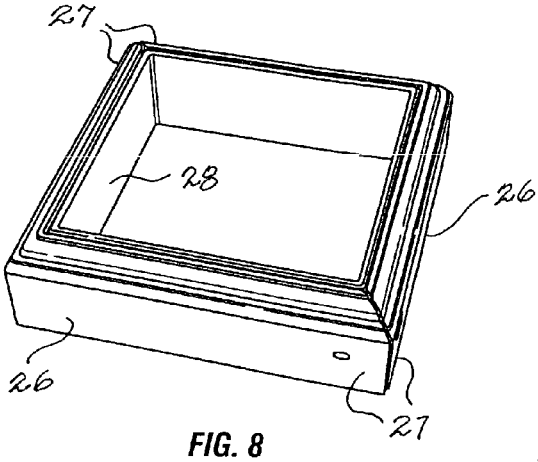

Moldings 26 are positioned around the elastomeric seal 28, as shown in FIGS. 7 and 8, with terminal ends 27 of the moldings 26 mutually joined in such manner as to secure the moldings 26 to the elastomeric seal 28, thereby securing the elastomeric seal 28 to the sidewall 22, and forcing the elastomeric seal 28 against the post 10 thereby securing the protective sleeve 20 to the post 10 for preventing moisture to enter between the elastomeric seal 28 and the post 10. The elastomeric seal 28 provides an outwardly directed second groove G2 which receives an interior ridge or ridges 29 present on each of the moldings 26, i.e., on all four sides thereof. Please see FIG. 10 for details.

Preferably, the elastomeric seal 28 provides a slopped surface 40 terminating upwardly at a peripheral ridge 42. Likewise, the moldings preferably provide an interior slopped surface 44 in contact with the slopped surface 40 of the elastomeric sea 28. These surfaces 40 and 44 lead water that tends to move between the molding 26 and the elastomeric seal 48 away from post 10, and as shown in FIG. 10, such moisture cannot enter the space between sidewall 22 and the post 10.

Figure 9:
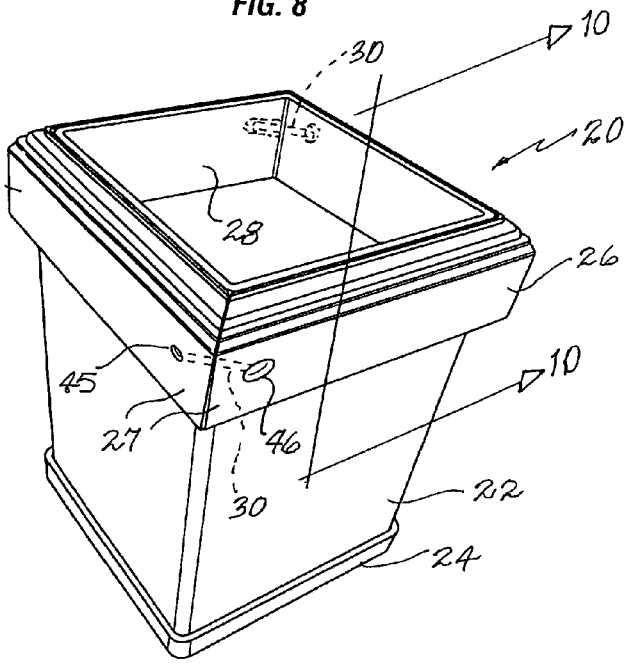
FIG. 9 is a perspective view of the sidewall and cap of FIG. 4 with the elastomeric seal and moldings of FIG. 8 mounted on the sidewall.

Preferably, fasteners 30 are directed across the terminal ends 27 of the moldings 26 so as to provide for cinching the moldings tightly around the molding 26 as shown in FIG. 9. Preferably, the fasteners 30 comprise a female threaded receiver pressed into hole 45 in one of the moldings 26, and a common machine screw inserted into a clearance hole 46 in the adjoining one of the moldings 26. In their positions, angled across the ends 27, the fasteners 30 are positioned within the second groove G2 of the elastomeric seal.

It should be noted, that the moldings 26 may alternately comprise four linear sections instead of two L-shaped portions or one U-shaped portion and one linear portion. Also, the apparatus may take an alternate shape other than square or rectangular as is shown in the illustrations. For instance the apparatus may be round or oval for accepting a post of that shape.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A protective sleeve apparatus for receiving and protecting one end of a structural post, the apparatus comprising:

a) a vertically oriented cylindrical sidewall having an open end defining a top edge thereof;

b) a molding; and c) a rectangular peripheral elastomeric seal having a downwardly open peripheral first U-shaped groove, and an outwardly open peripheral second U-shaped groove; the top edge of the cylindrical sidewalk engaged within the first U-shaped groove of the elastomeric seal; and ridges of the molding engaged within the second U-shaped groove thereby positioning the molding peripherally around the elastomeric seal and covering an outfacing surface thereof and thereby securing the molding to the elastomeric seal and to the cylindrical sidewall.

2. The apparatus of claim 1 wherein the elastomeric seal provides a peripheral slopped surface terminating upwardly with a peripheral ridge.

3. The apparatus or claim 2 wherein the moldings each provide an interior sloped surface in contact with the sloped surface of the elastomeric seal.

4. A protective sleeve apparatus for protecting an end of a structural posts, the apparatus comprising: a vertically oriented cylindrical sidewall closed at one end thereof and open at another end thereof; the another end of the cylindrical sidewall engaged within a downwardly open, first U-shaped peripheral groove of a rectangular elastomeric seal; a peripheral molding in circumventing contact around the elastomeric seal covering an outwardly facing surface thereof, horizontally extending ridges of the peripheral molding engaged within an outwardly open, second U-shaped peripheral groove of the elastomeric seal.

* * * * *